US007066122B2

(12) United States Patent
Ikihara et al.

(10) Patent No.: US 7,066,122 B2
(45) Date of Patent: Jun. 27, 2006

(54) VARIABLE VALVE TIMING CONTROLLER

(75) Inventors: Tadao Ikihara, Okazaki (JP); Yasushi Morii, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/221,917

(22) Filed: Sep. 9, 2005

(65) Prior Publication Data

US 2006/0048731 A1 Mar. 9, 2006

(30) Foreign Application Priority Data

Sep. 9, 2004 (JP) ..... 2004-261909

(51) Int. Cl.
*F01L 1/34* (2006.01)

(52) U.S. Cl. ..... 123/90.17; 123/90.15; 123/90.31; 464/160

(58) Field of Classification Search ..... 123/90.15, 123/90.16, 90.17, 90.18, 90.27, 90.31; 464/1, 464/2, 160

See application file for complete search history.

(56) References Cited

U.S. PATENT DOCUMENTS 6,269,785 B1 * 8/2001 Adachi ..... 123/90.17
6,497,208 B1 * 12/2002 Miyasaka ..... 123/90.17

FOREIGN PATENT DOCUMENTS

JP 2000-282820 10/2000

* cited by examiner

*Primary Examiner*—Thomas Denion
*Assistant Examiner*—Ching Chang
(74) *Attorney, Agent, or Firm*—Nixon & Vanderhye P.C.

(57) ABSTRACT

A space, which is formed between an outer side wall of a vane rotor and an inner side wall of a housing facing the outer side wall, in the inside direction of diameter is formed smaller than the space in the outside direction of diameter, before the vane rotor is fastened to a camshaft by a bolt.

8 Claims, 5 Drawing Sheets

VARIABLE VALVE TIMING CONTROLLER

CROSS-REFERENCE TO RELATED APPLICATION

This application is based on Japanese Patent Application No. 2004-261909 filed on Sep. 9, 2004, disclosure of which is incorporated herein by reference.

FIELD OF THE INVENTION

The present invention relates to a variable valve timing controller for varying an operation timing of at least either an intake valve or an exhaust valve in an internal combustion engine.

BACKGROUND OF THE INVENTION

There has been known a variable valve timing controller having a housing receiving a driving force from a crankshaft and a vane rotor in the housing transmitting the driving force to a camshaft, in related art. In related art, a valve operation timing is controlled by driving the vane rotor in the direction of a retard chamber or an advance chamber.

In related art, as shown in FIG. 11, a vane rotor 210 is fastened to a camshaft 230 by a bolt 220, so that both the vane rotor 210 and the camshaft 230 are rotated together. Further, before the vane rotor 210 is fastened to the camshaft 230 by the bolt 220, a space "t" is formed between an outer side wall 213 of the vane rotor 210 and an inner side wall 202 of the housing 200 facing the outer side wall 213.

When the vane rotor 210 is fastened to the camshaft 230 by a bolt 220, a reaction force against a pushing force from a bolt head 222 is operated from the camshaft 230 to the vane rotor 210. If diameter of the bolt head 222 is smaller than diameter of the camshaft 230, diameter of the reaction force from the camshaft 230 is larger than diameter of the pushing force from the bolt head 222. A top portion of the vane rotor 210 is leaned to the inner side wall 202 by a bending moment arisen on the vane rotor 210, so that the outer side wall 213 is formed such a chain double-dashed line shown in FIG. 11. For example, the space between the outer side wall 213 and the inner side wall 202, which is formed in the outside direction of diameter (the top side direction of the vane rotor 210), decreases only 5-20 micro meters or more than from the space "t". In this case, the vane rotor 210 can not smoothly rotate in the housing 200.

In related art, the space "t" is formed more largely than a preferable space in order to make the vane rotor 210 rotate smoothly, even if the space "t" decreases when the vane rotor 210 and the camshaft 230 are fastened by the bolt 220. For example, the space is formed at 30–80 micro meters.

However, when the vane rotor 210 and the camshaft 230 are fastened by the bolt 220, the space formed in the inside direction of diameter (the down side direction of the vane rotor 210) becomes larger than the preferable space even though the space formed in the outside direction of diameter of that can become the preferable space, so that oil leakage from the housing 200 can increase.

SUMMARY OF THE INVENTION

The present invention is made in view of the above matters, and it is an object of the present invention to provide a variable valve timing controller which can decrease oil leakage.

According to an aspect of the present invention, a space, which is formed between an outer side wall of a vane rotor and an inner side wall of a housing facing with the outer side wall, in the inside direction of a diameter is formed smaller than the space in the outside direction of diameter before the vane rotor is fastened to a driven shaft by a fastening member.

Therefore, the space between the outer side wall of the vane rotor and the inner side wall of the housing can be small even if the vane rotor and the driven shaft are fastened, so that the oil leakage can be restrained.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF PREFERRED EMBODIMENTS

Embodiments of the present invention will be described hereinafter with reference to the drawings.

First Embodiment

Figure 1A:
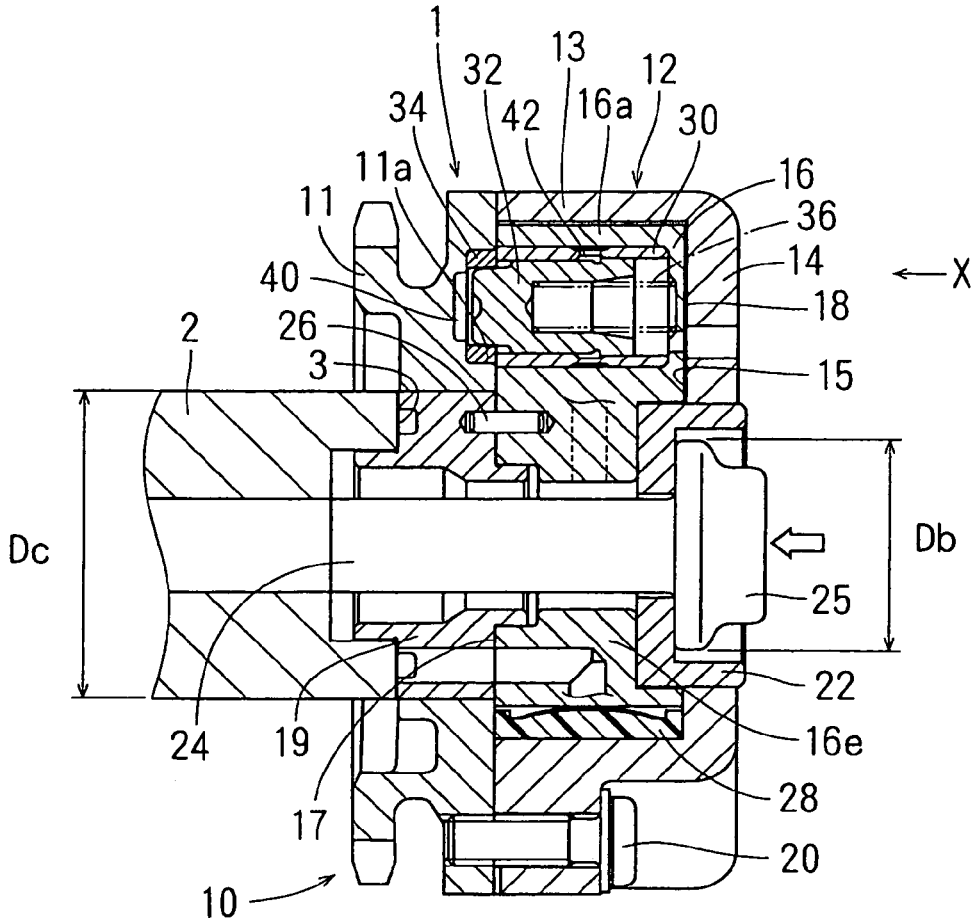
FIG. 1A is a cross-sectional view showing a variable valve timing controller according to a first embodiment.

A variable valve timing controller according to a first embodiment of the present invention is shown in FIG. 1. The variable valve timing controller 1 is controlled by an oil pressure, and for example it can control a valve timing of an intake valve.

A housing 10 has a chain sprocket 11 and a shoe housing 12. The shoe housing 12 is made of aluminum and is formed by one member. The shoe housing 12 has four shoes 12*a*, 12*b*, 12*c* and 12*d* (In FIG. 1B, shoes 12*a* and 12*b* are only shown), a circular shoe wall 13, and a front plate 14, which is located at the opposite side of the chain sprocket 11 against the shoe wall 13. The chain sprocket 11 and the shoe hosing 12 are fastened by a bolt 20. The chain sprocket 11 is connected by a timing chain (not shown) for transmitting a driving force from a crankshaft (not shown) and rotates in synchronization with the crankshaft.

A camshaft 2 drives the intake valve (not shown) by the driving force transmitted through the variable valve timing operation device 1 from the crankshaft. The camshaft 2 is inserted into the chain sprocket 11 so as to be able to rotate with a predetermined phase difference against the chain sprocket 11.

A vane rotor 16 is made of aluminum. One outer side wall 17 of the vane rotor 16 faces an end face 3 of the camshaft 2 across a bush 19. A bush 22 is clipped between a bolt head 25 and the other outer side wall 18 of the vane rotor 16. The camshaft 2, the vane rotor 16, and the bushes 19, 22 are coaxially fastened by a bolt 24. The bolt head 25 pushes the outer side wall 18 in the axial direction of the camshaft 2 through the bush 22. Relation between diameter Dc of the camshaft 2 and diameter Db of the bolt head 25 is Dc>Db.

Position of the vane rotor 16 and the bush 19 in the rotating direction is defined by fitting a positioning pin 26 to the vane rotor 16 and the bush 19. The camshaft 2, the housing 10, and the vane rotor 16 rotate clockwise as seen from the X direction. The clockwise direction is described as the advance direction hereinafter.

The shoes 12*a*, 12*b*, 12*c* and 12*d*, which are formed as trapezoid, extended in the inside direction of diameter, and are located in the rotating direction of the shoe wall 13 at regular interval. Four fan-like rooms 50 in order to house vanes 16*a*, 16*b*, 16*c* and 16*d* (only shoe 16*a* is shown in FIG. 1) are formed between the shoes 12*a*, 12*b*, 12*c* and 12*d*.

Figure 1B:
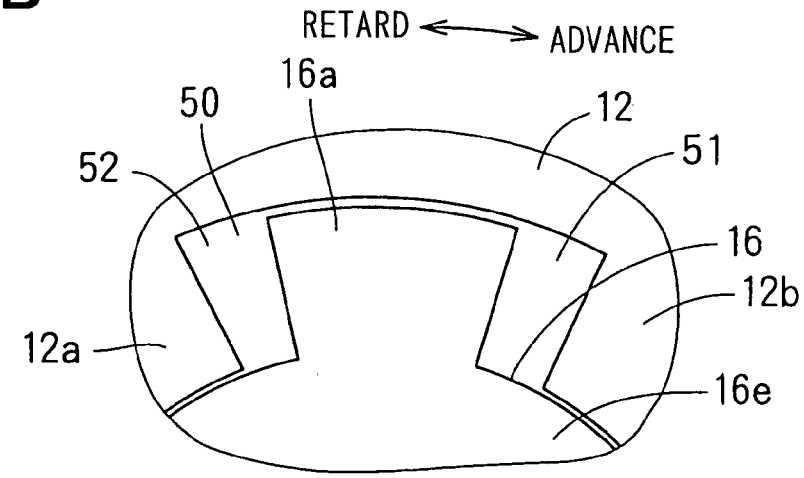
FIG. 1B is a schematic view showing a room separated by a vane rotor.

The vane rotor 16 has a boss 16*e* to insert the bolt 24 and vanes 16*a*, 16*b*, 16*c*, and 16*d* located at the outside direction of diameter of the vane rotor 16 at regular interval in the rotating direction. The vane rotor 16 is inserted into the housing 10 to be able to rotate. The room 50 is divided into two chambers by each of the vanes, that is, as shown in FIG. 1B, a retard oil pressure chamber 51 located at the right side of the room 50 and an advance oil pressure chamber 52 located at the left side of the room 50. An arrow shown in FIG. 1B represents a retard or an advance of the vane rotor 16.

A seal member 28 is placed between each shoe and the boss 16*e*, and between each vane and the shoe wall 13. The seal member 28 is inserted between boss 16*e* and a groove formed to the shoe wall 13, and is urged toward each shoe and shoe wall 13 by such as a spring, so that the seal member 28 can restrain oil leakage between each retard oil pressure chamber and each advance oil pressure chamber.

A cylindrical guide ring 30 is press-fitted into the vane 16*a*. A cylindrical stopper piston 32 is inserted into the guide ring 30 to be able to move in the direction of a rotation axis. A fitting ring 34 is press-fitted into a concave 11*a* formed to the chain sprocket 11. The stopper piston 32 and the fitting ring 34 are taper-shaped to smoothly be fitted each other. The stopper piston 32 is urged toward the fitting ring 34 by a spring 36. The stopper piston 32, the fitting ring 34, and the spring 36 hold the rotation of the vane rotor 16. An oil chamber 40 is formed at the side of the chain sprocket 11 of the stopper piston 32. An oil chamber 42 is formed at the periphery of the stopper piston 32. Pressure of oil supplied with the oil chambers 40, 42 is operated in such a manner that the stopper piston 32 extracts from the fitting ring 34. The oil chamber 40 communicates with each advance oil pressure chamber, and the oil chamber 42 communicates with each retard oil pressure chamber. A top portion of the stopper piston 32 can be fitted to the fitting ring 34 when the vane rotor 16 is located at the most retarded position. Rotation of the vane rotor 16 is held while the stopper piston 32 is fitted to the fitting ring 34.

When the vane rotor 16 rotates toward the advance side from the most retarded position, the stopper pin 32 can not be fitted to the fitting ring 34 because of the difference of the position of the stopper piston 32 and the fitting ring 34. The vane rotor 16 relatively rotates against the housing 10 by respectively supplying oil with each retard oil pressure chamber and each advance oil pressure chamber from an oil pump (not shown).

Figure 2:
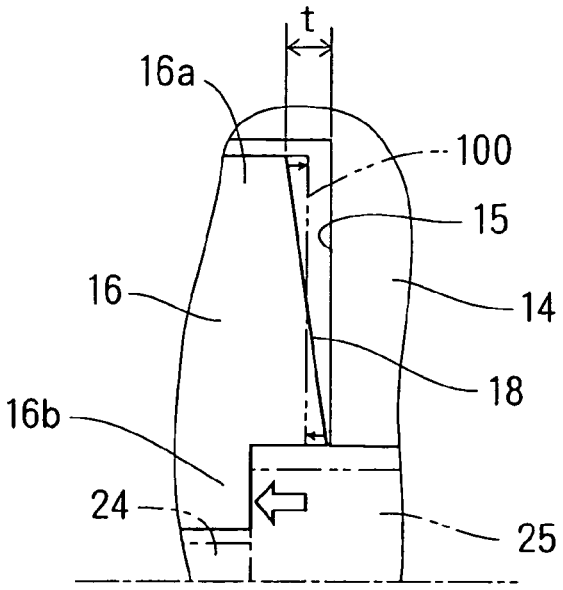
FIG. 2 is a schematic view showing an outer side wall of the vane rotor and an inner side wall of the housing according to the first embodiment.
Figure 3:
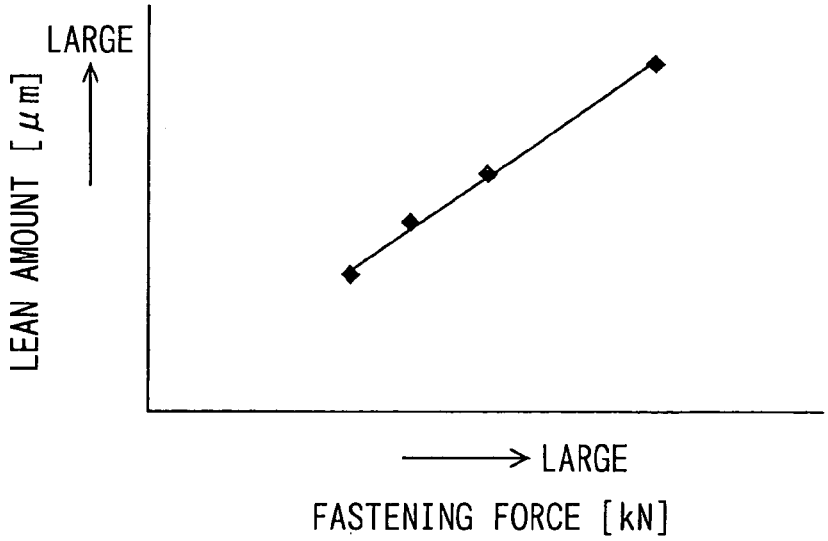
FIG. 3 is a plot showing relation between a fastening force of a bolt and lean amount of the vane rotor according to the first embodiment.

As shown in FIG. 2, before the camshaft 2 and the vane rotor 16 are fastened by the bolt 24, an outer side wall 18 of the vane rotor 16 in the inside direction of diameter projects toward an inner side wall 15 of the front plate 14. A space "t" is formed between the outer side wall 18 and the inner side wall 15. The space formed in the outside direction of diameter is smaller than the space formed in the inside direction of diameter. When the camshaft 2 and the vane rotor 16 are fastened by the bolt 24, the vane rotor 16 is transformed such as a chain double-dashed line 100. That is, an outer side wall 18 in the inside direction of diameter is away from the inner side wall 15, and the outer side wall 18 in the outside direction of diameter approaches the inner side wall 15. The larger a fastening force of the bolt 24 is, the larger lean amount of the vane rotor 16 is, as shown in FIG. 3.

Before the camshaft 2 and the vane rotor 16 are fastened by the bolt 24, the space "t" may be defined in such a manner that the vane rotor 16 can smoothly rotate and oil leakage can be restricted as much as possible. Especially, the space "t" in the inside direction of diameter may be defined more than 5 micro meters or preferably 10–20 micro meters smaller than the space "t" in the outside direction of diameter, because the space decreases only 5–20 micro meters or more than after fastened by the bolt 24.

Figure 4:
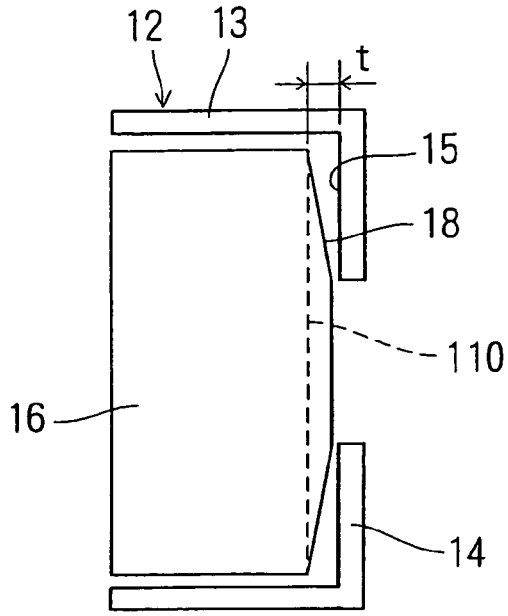
FIG. 4 is a schematic view showing the outer side wall of the vane rotor and the inner side wall of the housing before fastened by the bolt according to the first embodiment.

In the present embodiment, before the camshaft 2 and the vane rotor 16 are fastened, the space "t" between the inner side wall 15 and the outer side wall 18 in the inside direction of diameter is smaller than the space of related art shown by a dashed line 110 in FIG. 4. The space "t" in the outside direction of diameter of the present embodiment is equal to the related art. When the camshaft 2 and the vane rotor 16 are fastened, the space "t" in the outside direction of diameter gets smaller and the space "t" in the inside direction of diameter gets larger. Thus, the space "t" in the outside direction of diameter gets almost equal to the space "t" in the inside direction of diameter, so that the oil leakage can decrease.

Figure 5:
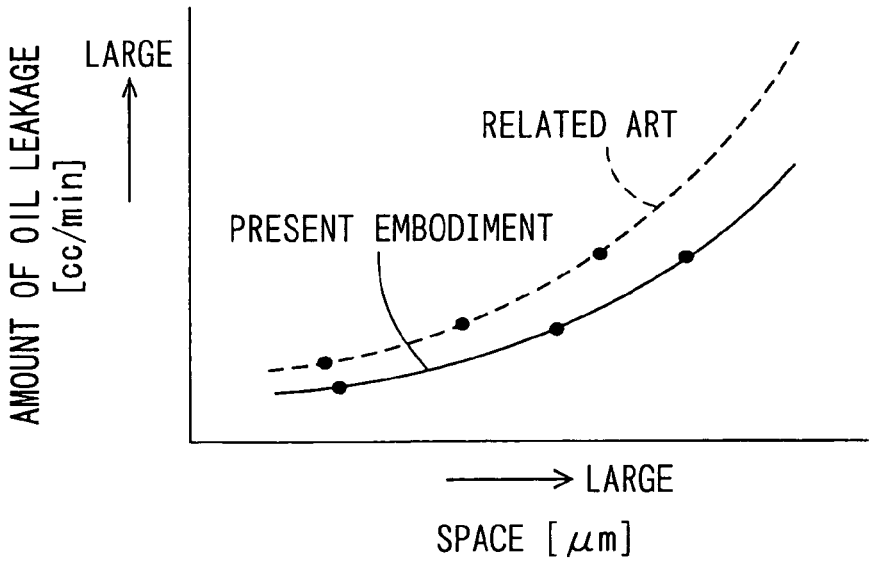
FIG. 5 is a plot showing relation between amount of oil leakage and a space between the outer side wall and the inner side wall before fastened by the bolt according to the first embodiment.

As shown in FIG. 5, before the camshaft 2 and the vane rotor 16 are fastened, if the space "t" in the outside direction of diameter between present embodiment and related art is the same, amount of oil leakage of the present embodiment can be small comparing with that of related art. Therefore, even if the bolt 24 is fastened, the oil leakage of the present embodiment can be also small comparing with that of related art.

Lean amount of the vane rotor 16 by fastening the bolt 24 is proportional to 1/E if Young's modulus of the material of the vane rotor 16 is E. That is, lean amount is varied according to the material of the vane rotor 16. For example, lean amount of the vane rotor 16 made of iron is about the one-third of that made of aluminum. Therefore, the space "t" can be formed considering the material of the vane rotor 16.

Second-Sixth Embodiments

Figure 6:
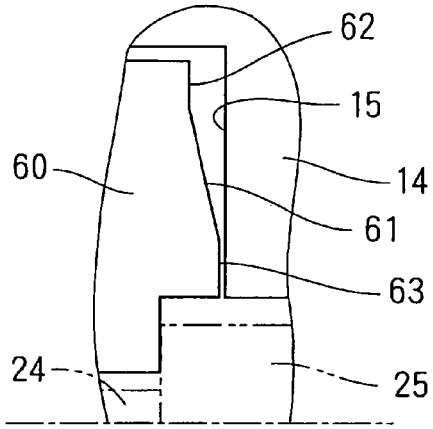
FIG. 6 is a schematic view showing an outer side wall of a vane rotor and an inner side wall of a housing according to a second embodiment.

In the second embodiment shown in FIG. 6, before the camshaft 2 and a vane rotor 60 are fastened by the bolt 24, an outer side wall 61 of the vane rotor 60 in the inside direction of diameter projects toward the inner side wall 15 of the housing 14. The plane portions 62, 63 are formed at the outer side wall 61 in the outside and inside direction of diameter. A space between the outer side wall 61 and the inner side wall 15 can be easily measured due to the plane portions 62, 63 before the camshaft 2 and the vane rotor 60 are fastened.

Figure 7:
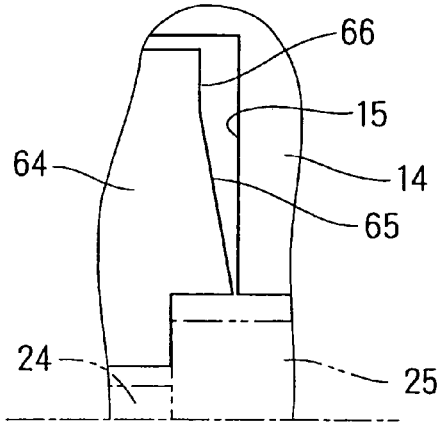
FIG. 7 is a schematic view showing an outer side wall of a vane rotor and an inner side wall of a housing according to a third embodiment.

In the third embodiment shown in FIG. 7, before the camshaft 2 and a vane rotor 64 are fastened by the bolt 24, an outer side wall 65 of the vane rotor 64 in the inside direction of diameter projects toward the inner side wall 15 of the housing 14. The plane portion 66 is only formed on the outer side wall 65 in the outside direction of diameter.

Figure 8:
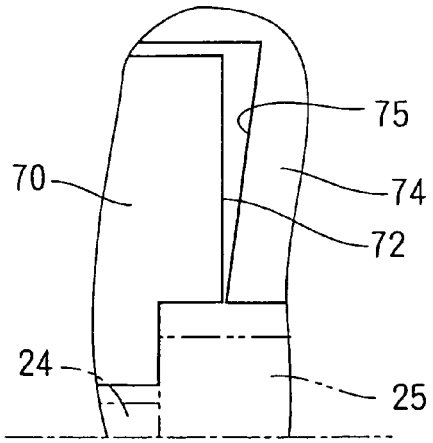
FIG. 8 is a schematic view showing an outer side wall of a vane rotor and an inner side wall of a housing according to a fourth embodiment.

In the fourth embodiment shown in FIG. 8, before the camshaft 2 and a vane rotor 70 are fastened by the bolt 24, an inner side wall 75 of a housing 74 in the inside direction of diameter projects toward an outer side wall 72 of the vane rotor 70.

Figure 9:
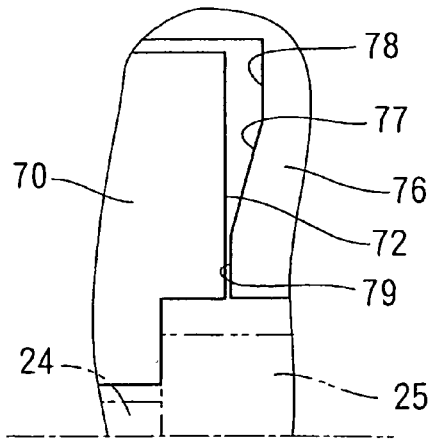
FIG. 9 is a schematic view showing an outer side wall of a vane rotor and an inner side wall of a housing according to a fifth embodiment.

In the fifth embodiment shown in FIG. 9, before the camshaft 2 and the vane rotor 70 are fastened by the bolt 24, an inner side wall 77 of a housing 76 in the inside direction of diameter projects toward the outer side wall 72 of the vane rotor 70. The plane portions 78, 79 are formed at the inner side wall 77 of the housing 76 in the outside and inside direction of diameter. A space between the outer side wall 72 and the inner side wall 77 can be easily measured due to the plane portions 78, 79 before the camshaft 2 and the vane rotor 70 are fastened.

Figure 10:
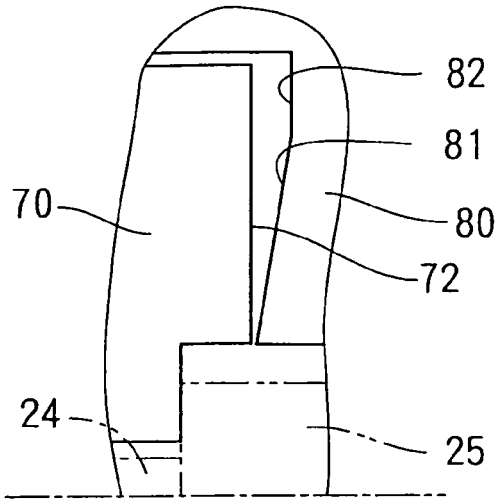
FIG. 10 is a schematic view showing an outer side wall of a vane rotor and an inner side wall of a housing according to a sixth embodiment.
Figure 11:
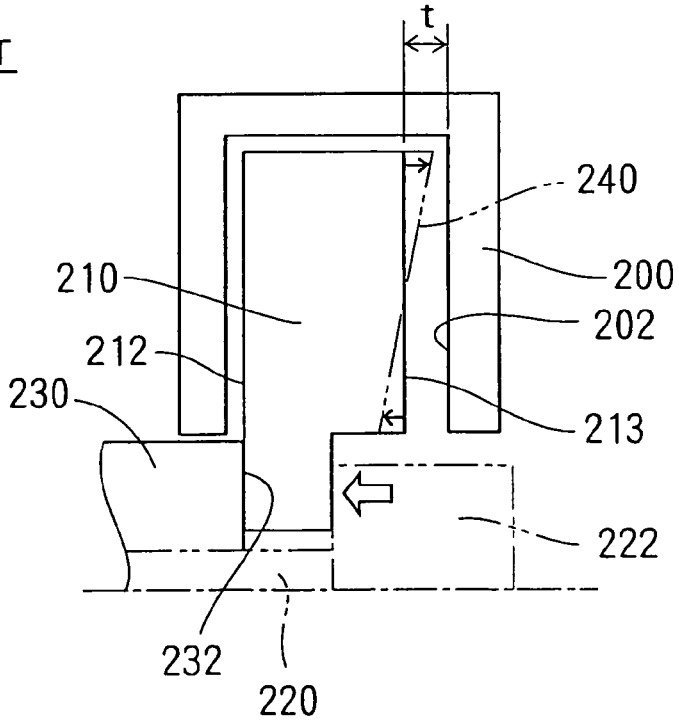
FIG. 11 RELATED ART
FIG. 11 is a schematic view showing an outer side wall of a vane rotor and an inner side wall of a housing according to a related art.

In the sixth embodiment shown in FIG. 10, before the camshaft 2 and a vane rotor 70 are fastened by the bolt 24, an inner side wall 81 of a housing 80 in the inside direction of diameter projects toward the outer side wall 72 of the vane rotor 70. The plane portion 83 is only formed at the inner side wall 81 in the outside direction of diameter.

In these embodiments, the space between the outer side wall of the vane and the inner side wall of the housing in the inside direction of diameter is smaller than the space in the outside direction of diameter. Therefore, like the first embodiment, the space in the outside direction of diameter can get small even if the camshaft and the vane rotor are fastened, so that oil leakage from the space can be restrained. Further, oil supplied with the variable valve timing controller from an oil pump can be restrained, so that the oil pump can be downsized.

Other Embodiments

Both the outer side wall of the vane rotor and the inner side wall of the housing in the inside direction of diameter may project toward each other.

Although the shoe wall 13 and the front plate 14 are integrally formed in the above embodiments, they may be separately formed or be formed by different materials.

The driving force from the crankshaft to the camshaft may be transferred by such as a timing pulley or a timing gear.

The stopper piston 32 may be fitted at the fitting ring 34 by moving in the radial direction. Furthermore, the variable valve timing controller 1 may not have a means to hold the rotation of the vane rotor.

Though, in the above embodiment, the variable valve timing controller 1 operates the intake valve timing, it may operate an exhaust valve timing, or both the intake and exhaust valve timings.

What is claimed is:

1. A variable valve timing controller arranged at a pathway transferring a driving force from a driving shaft to a driven shaft opening or closing at least one of an intake valve and an exhaust valve, the variable valve timing controller controlling an opening/closing timing of the intake or exhaust valve, comprising:

a housing rotating with the driving shaft and having a room formed within a predetermined angle in the rotating direction of the driving shaft;

a vane rotor having a vane, which divides the room into two chambers, and relatively rotated against the housing by a pressure of oil in the two chambers; and a fastening member having a pressure portion, diameter of which is smaller than diameter of the driven shaft, and fastening the vane rotor to the driven shaft by pressing the pressure portion toward the axial direction of the driven shaft, wherein a space is formed between an outer side wall of the vane rotor in the side of the pressure portion and an inner side wall of the housing facing the outer side wall, and before the vane rotor is fastened to the driven shaft by the fastening member, the space in the inside direction of diameter is formed smaller than the space in the outside direction of diameter.

2. The variable valve timing controller according to claim 1, wherein the outer side wall of the vane rotor in the inside direction of diameter projects toward the inner side wall of the housing.

3. The variable valve timing controller according to claim 2, wherein the outer side wall of the vane rotor in both the inside and outside direction of diameter has plane portions.

4. The variable valve timing controller according to claim 2, wherein only the outer side wall of the vane rotor in the outside direction of diameter has a plane portion.

5. The variable valve timing controller according to claim 1, wherein the inner side wall of the housing in the inside direction of diameter projects toward the outer side wall of the vane rotor.

6. The variable valve timing controller according to claim 5, wherein the inner side wall of the housing in both the inside and outside direction of diameter has plane portions.

7. The variable valve timing controller according to claim 5, wherein only the inner side wall of the housing in the inside direction of diameter has a plane portion.

8. The variable valve timing controller according to claim 1, wherein the vane rotor is made of aluminum.

* * * * *